US011069224B1

(12) United States Patent
Hsieh et al.

(10) Patent No.: US 11,069,224 B1
(45) Date of Patent: Jul. 20, 2021

(54) SMOKE DETECTOR AND CHAMBER

(71) Applicant: EVERDAY TECHOLOGY CO., LTD., Yilan County (TW)

(72) Inventors: Shih-Hsiung Hsieh, Yilan County (TW); Chi-Yu Lan, Yilan County (TW)

(73) Assignee: EVERDAY TECHOLOGY CO., LTD., Yilan County (TW)

( * ) Notice: Subject to any disclaimer, the term of this patent is extended or adjusted under 35 U.S.C. 154(b) by 0 days.

(21) Appl. No.: 16/925,339

(22) Filed: Jul. 10, 2020

(51) Int. Cl.
*G08B 29/18* (2006.01)
*G08B 17/107* (2006.01)
*G08B 17/113* (2006.01)

(52) U.S. Cl.
CPC ..... *G08B 29/183* (2013.01); *G08B 17/107* (2013.01); *G08B 17/113* (2013.01)

(58) Field of Classification Search
CPC ... G08B 29/183; G08B 17/107; G08B 17/113
USPC ..... 340/522
See application file for complete search history.

(56) References Cited

U.S. PATENT DOCUMENTS 4,103,997 A * 8/1978 Araki ..... G01N 21/53 250/574
4,397,557 A * 8/1983 Herwig ..... G01N 21/53 356/342
4,758,733 A * 7/1988 Mochizuki ..... G08B 17/107 250/574
4,897,634 A * 1/1990 Sawa ..... G08B 17/107 340/630
4,906,978 A * 3/1990 Best ..... G08B 17/107 250/574
5,138,302 A * 8/1992 Nagaoka ..... G08B 17/107 250/574
5,400,014 A * 3/1995 Behlke ..... G08B 17/107 250/574

* cited by examiner

*Primary Examiner* — John A Tweel, Jr.
(74) *Attorney, Agent, or Firm* — Li & Cai Intellectual Property Office

(57) ABSTRACT

A smoke detector and a chamber are provided. The chamber includes a bottom plate, top plate, a plurality of baffle ribs disposed between the bottom plate and top plate, a transmitter base disposed between the bottom plate and top plate, and a receiver base disposed between the bottom plate and top plate. The receiver base is arranged apart from the transmitter base, and a center point of the chamber, being taken as an apex, the receiver base, and the transmitter base jointly define an angle being in a range of 45 degrees to 65 degrees.

9 Claims, 7 Drawing Sheets

SMOKE DETECTOR AND CHAMBER

FIELD OF THE DISCLOSURE

The present disclosure relates to a smoke detector and a chamber, and more particularly to a smoke detector and a chamber that are capable of avoiding false alarm.

BACKGROUND OF THE DISCLOSURE

In order to prevent fires, people may install fire warning devices in their houses to avoid related accidents. Among the various fire warning devices, a smoke detector has the fastest warning speed. Therefore, most people will choose to install a smoke detector.

A conventional smoke detector includes a body, a transmitter disposed in the body, and a receiver disposed in the body. The detection principle of the conventional smoke detector is that when smoke from a fire enters the body, a detection light emitted by the transmitter is scattered due to the detection light impacting on a plurality of particles of the smoke, so that the receiver receives the detection light to issue an alarm. Accordingly, people who hear the alarm can immediately escape or take measures to extinguish the fire. However, when the conventional smoke detector detects cooking fumes (i.e., a white smoke) generated during cooking, the conventional smoke detector may issue a false alarm without the occurrence of an actual fire incident.

SUMMARY OF THE DISCLOSURE

In response to the above-referenced technical inadequacies, the present disclosure provides a smoke detector and a chamber to effectively improve the issues associated with conventional smoke detectors.

In one aspect, the present disclosure provides a smoke detector, which includes a chamber, an emitter, and a receiver. The chamber includes a bottom plate, a top plate, a plurality of baffle ribs, a transmitter base, and a receiver base. The baffle ribs are disposed between the bottom plate and the top plate. The baffle ribs are spaced apart from each other. The chamber defines a smoke collection space surrounded by the top plate, the bottom plate, and the baffle ribs. The chamber has a plurality of main channels that are in spatial communication with the smoke collection space. Any two of the baffle ribs adjacent to each other are provided with one of the main channels there between. The transmitter base is arranged in the smoke collection space. The receiver base is arranged in the smoke collection space. The receiver base is arranged apart from the transmitter base, and a center point of the chamber, being taken as an apex, the receiver base, and the transmitter base jointly define an angle being in a range of 45 degrees to 65 degrees. The emitter is disposed in the transmitter base. The emitter is capable of emitting a detection light toward the smoke collection space. The receiver is disposed in the receiver base. The receiver is capable of receiving the detection light.

In certain embodiments, the present disclosure provides a chamber, which includes a bottom plate, a top plate, a plurality of baffle ribs, a transmitter base, and a receiver base. The baffle ribs are disposed between the bottom plate and the top plate. The baffle ribs are spaced apart from each other. The chamber defines a smoke collection space surrounded by the top plate, the bottom plate, and the baffle ribs. The chamber has a plurality of main channels that are in spatial communication with the smoke collection space. Any two of the baffle ribs adjacent to each other are provided with one of the main channels therebetween. The transmitter base is arranged in the smoke collection space. The receiver base is arranged in the smoke collection space. The receiver base is arranged apart from the transmitter base, and a center point of the chamber, being taken as an apex, the receiver base, and the transmitter base jointly define an angle being in a range of 45 degrees to 65 degrees.

Therefore, the smoke detector and the chamber of the present disclosure can reduce the false alarms caused by the detection of cooking fumes (i.e., white smoke) generated during cooking through the design with an angle being in the range of 45 degrees to 65 degrees among the transmitter base, the receiver base, and the center point of the chamber. Specifically, when the detection light is irradiated on smoke, the detection light can penetrate the white smoke particles more easily than the black smoke particles (i.e., the smoke generated during a fire), and a reflection angle when the detection light is irradiated on the black smoke particles is larger than a reflection angle when irradiated on the white smoke particles. When the emitter disposed in the transmitter base emits the detection light, it would be significantly more difficult for the detection light reflected by the white smoke particles to be received by the receiver disposed in the receiver base, as compared to the detection light reflected by the black smoke particles. Accordingly, the smoke detector can prevent the receiver from receiving the detection light reflected by the white smoke particles, so as to reduce false alarms issued from the smoke detector due to the cooking fumes.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
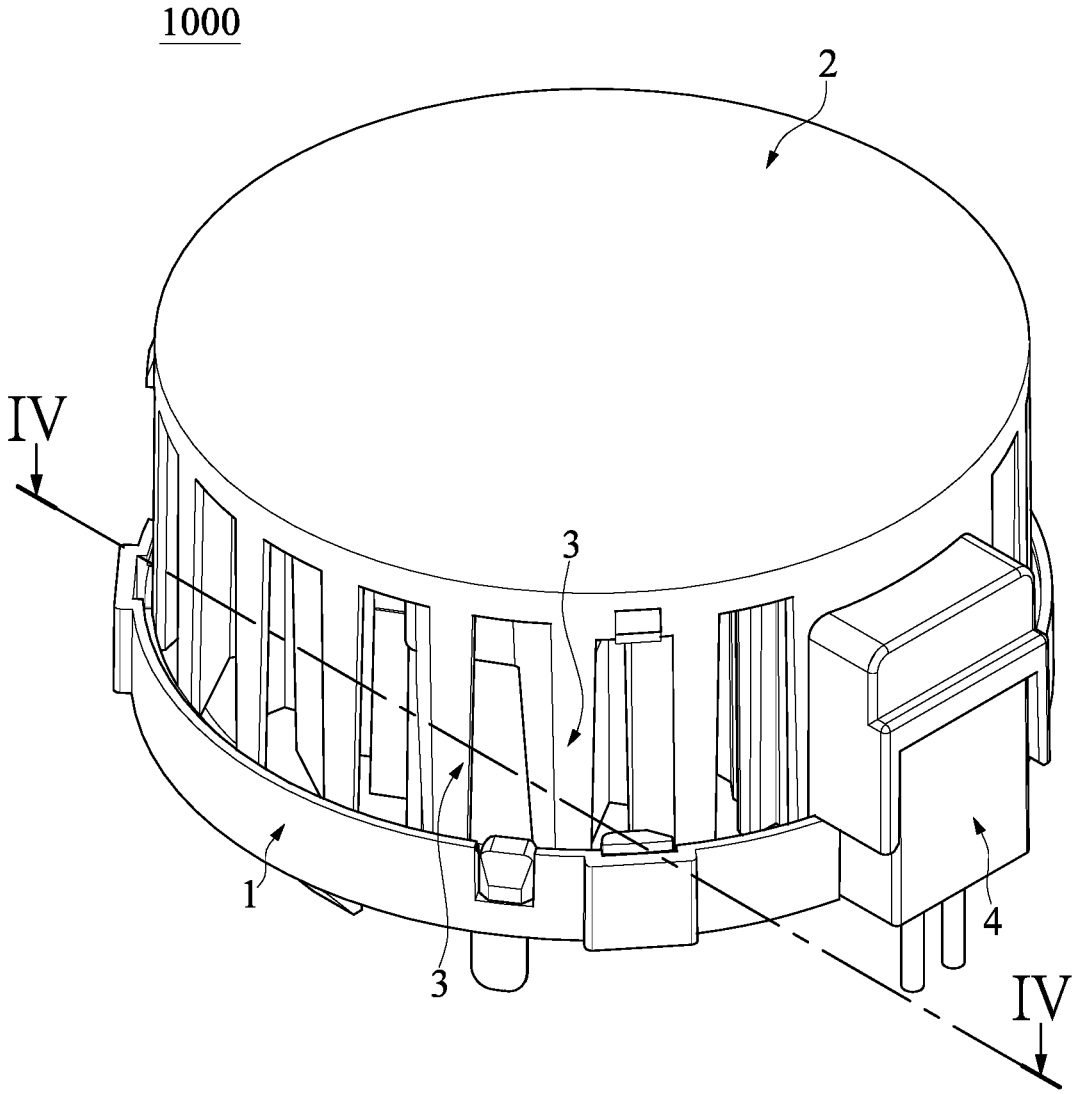
FIG. 1 is a perspective view of a smoke detector according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 7, an embodiment of the present disclosure provides a smoke detector 1000 that includes a chamber 100, an emitter 200 disposed in the chamber 100, and a receiver 300 that is disposed in the chamber 100. Specifically, when a smoke generated by a fire in an environment enters the chamber 100 of the smoke detector 1000, a detection light emitted by the emitter 200 is scattered by a plurality of particles of the smoke, so that the receiver 300 receives the detection light and issues a warning in the form of a fire alarm. In other words, any smoke detector that does not determine the occurrence of a fire incident by receiving the scattered detection light by the particles of smoke is not the smoke detector 1000 of the present disclosure. It should be noted that the chamber 100, the emitter 200, and the receiver 300 in the present embodiment are jointly defined as the smoke detector 1000, but the present disclosure is not limited thereto. For example, in other embodiments of the present disclosure, the chamber 100 can be independently used (e.g., sold) or can be used in cooperation with other components. The following description describes the structure and connection relationship of each component of the smoke detector 1000.

Figure 2:
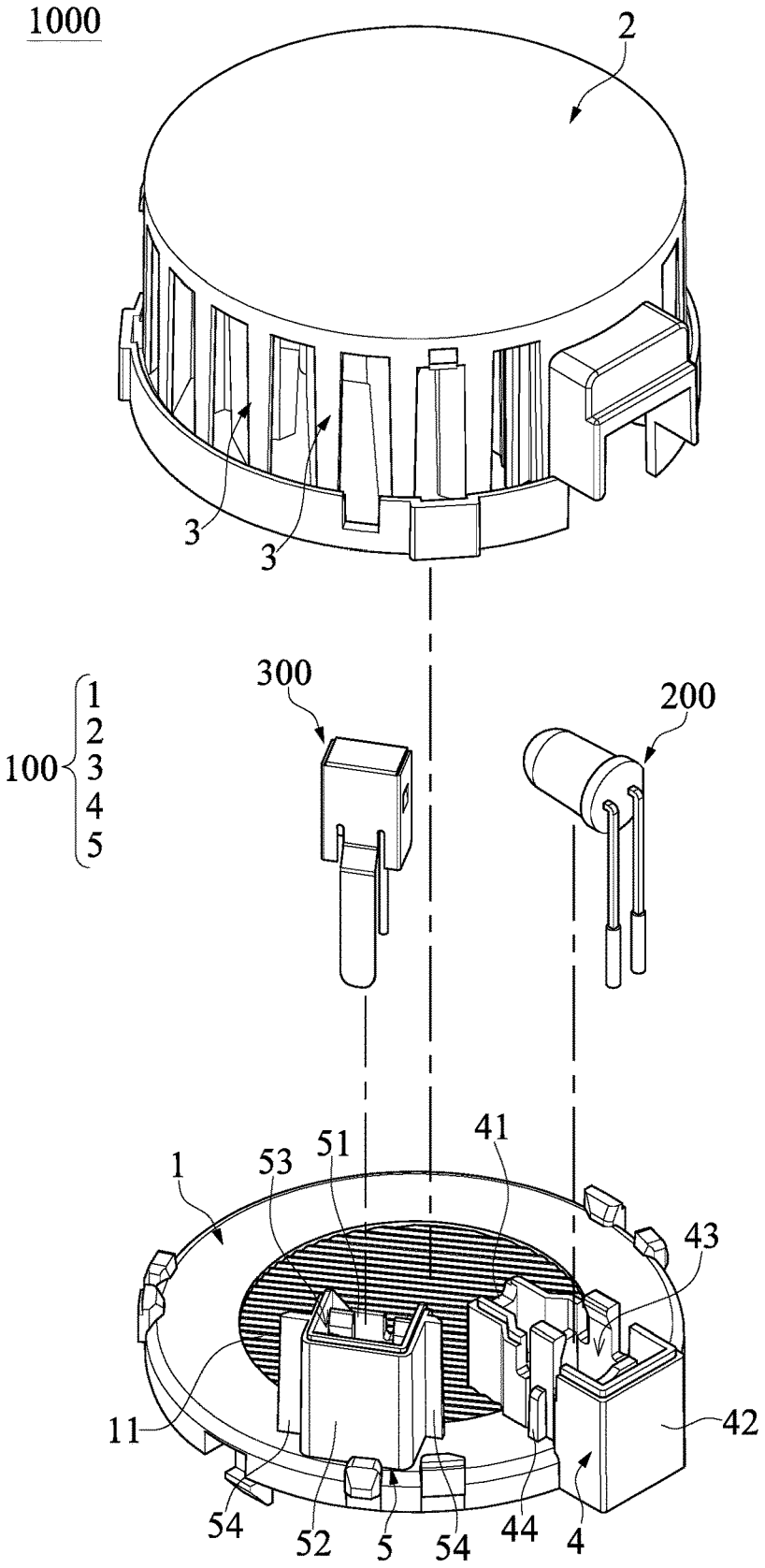
FIG. 2 is an exploded view of the smoke detector according to the present disclosure.
Figure 3:
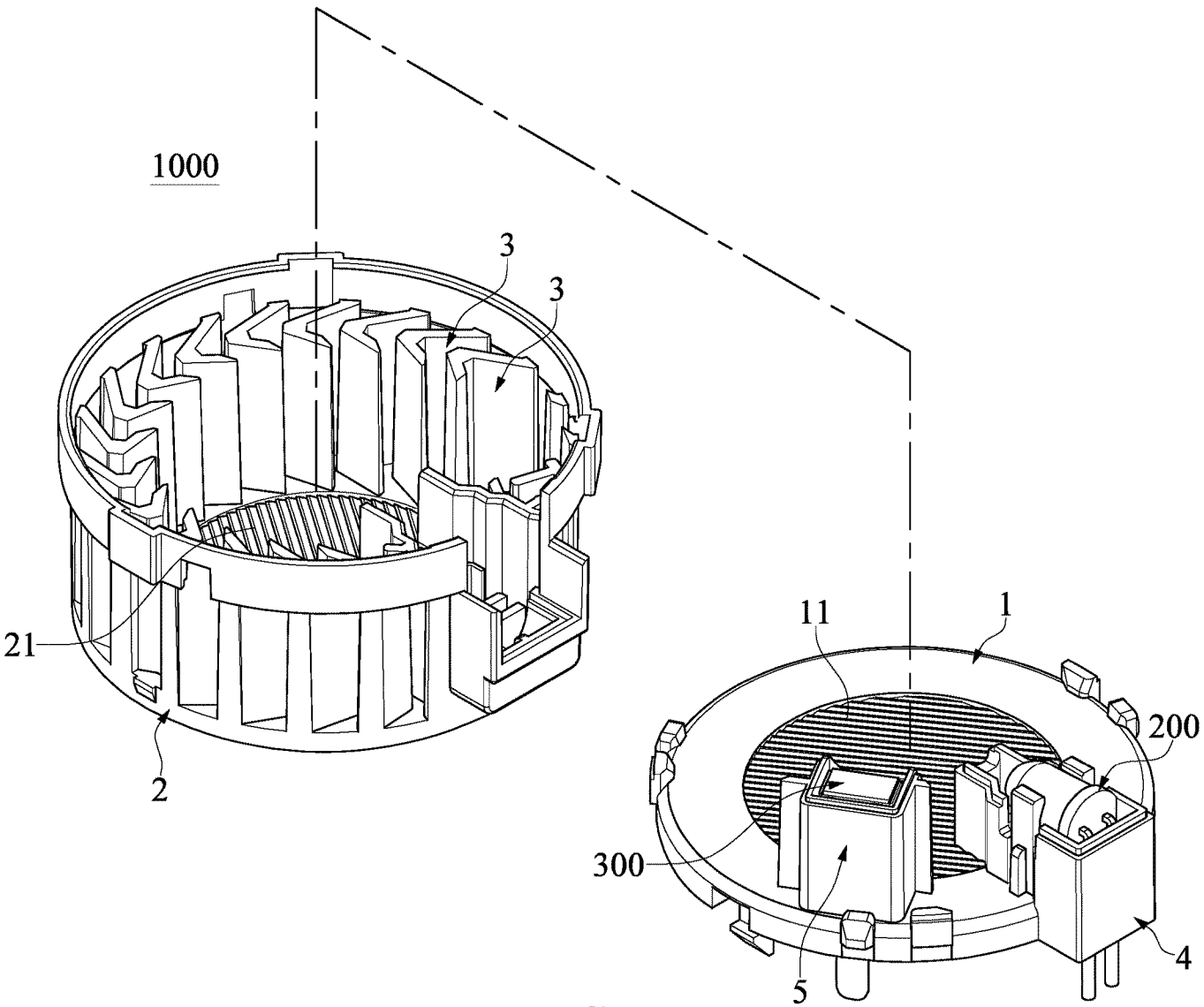
FIG. 3 is another exploded view of the smoke detector according to the present disclosure.
Figure 4:
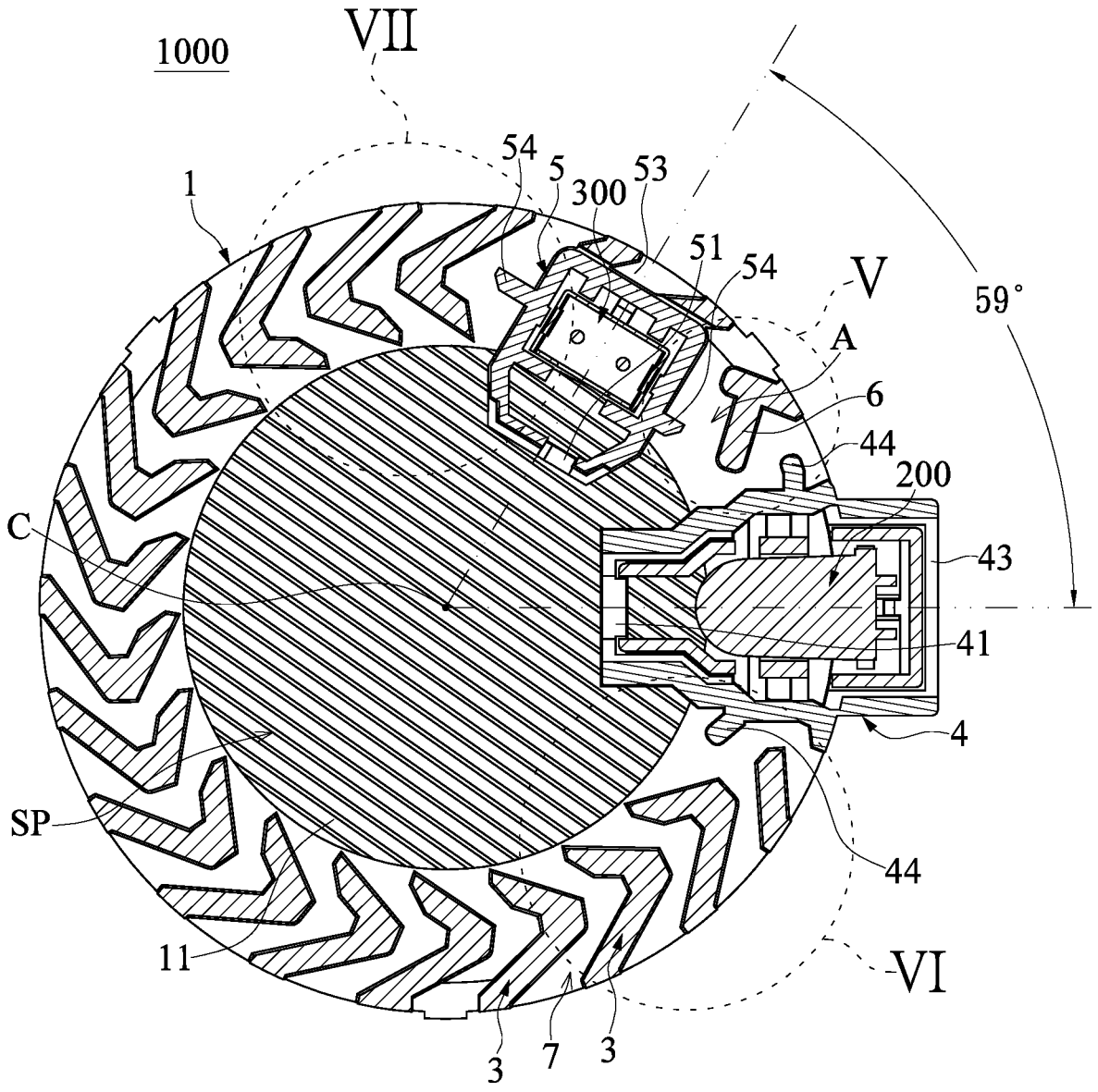
FIG. 4 is a cross-sectional view taken along line IV-IV of FIG. 1.

Referring to FIG. 2 to FIG. 4, the chamber 100 includes a bottom plate 1, a top plate 2, a plurality of baffle ribs 3 disposed between the bottom plate 1 and the top plate 2, a transmitter base 4 disposed between the bottom plate 1 and the top plate 2, a receiver base 5 disposed between the bottom plate 1 and the top plate 2, and an assist rib 6 that is disposed between the bottom plate 1 and the top plate 2. Further, the chamber 100 defines a smoke collection space SP surrounded by the top plate 2, the bottom plate 1, and the baffle ribs 3. To clearly illustrate the structure of the chamber 100, the chamber 100 defines a center point C at the center of cross section thereof and a setting area A arranged between the transmitter base 4 and the receiver base 5.

The bottom plate 1 in the present embodiment is substantially in a disc-shape. A first rough portion 11 is formed on a circular area of the bottom plate 1. The first rough portion 11 is composed of a plurality of elongated convex structures spaced apart from each other in parallel. In other words, the first rough portion 11 is in a step shape, but the present disclosure is not limited thereto.

The top plate 2 in the present embodiment is substantially in a disc-shape. A second rough portion 21 is formed on a circular area of the top plate 2. The second rough portion 21 is composed of a plurality of elongated convex structures spaced apart from each other in parallel. In other words, the second rough portion 21 is in the same shape (i.e., a step shape) as the first rough portion 11. Accordingly, when there is no smoke in the smoke collection space SP, the second rough portion 21 and the first rough portion 11 are configured to prevent the detection light in the smoke collection space SP from being scattered.

Figure 5:
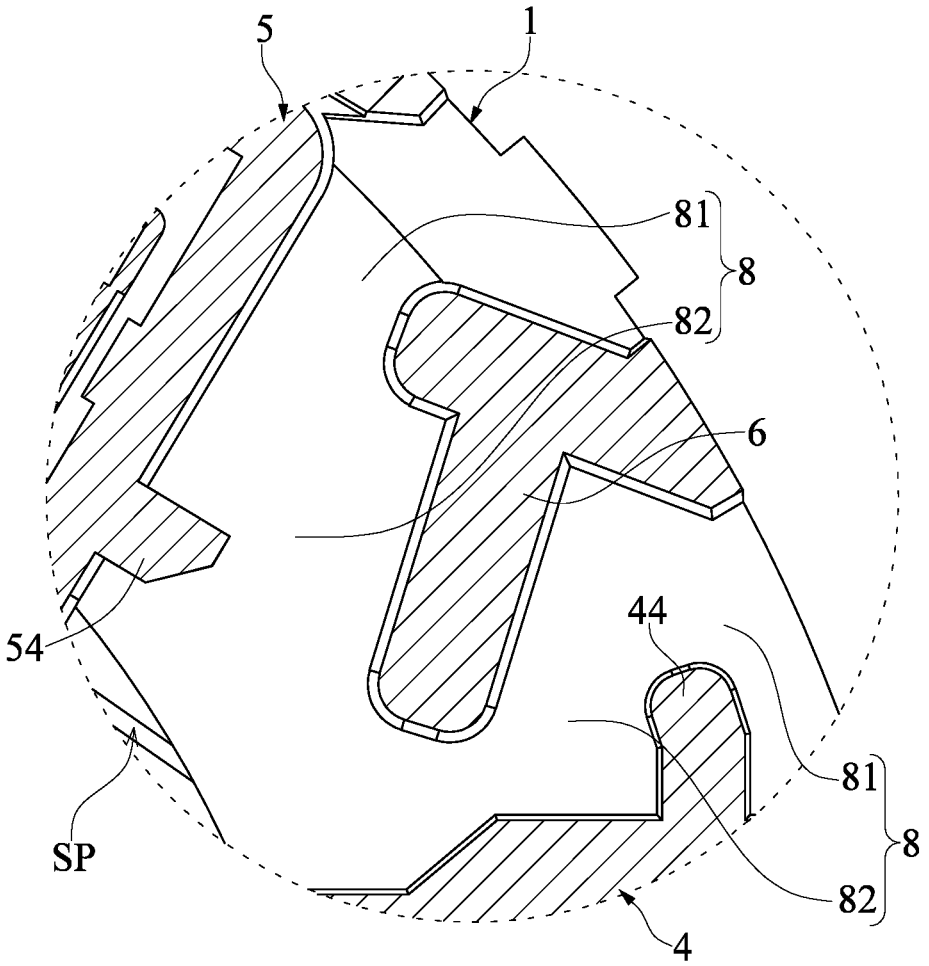
FIG. 5 is an enlarged view showing part V of FIG. 4.
Figure 6:
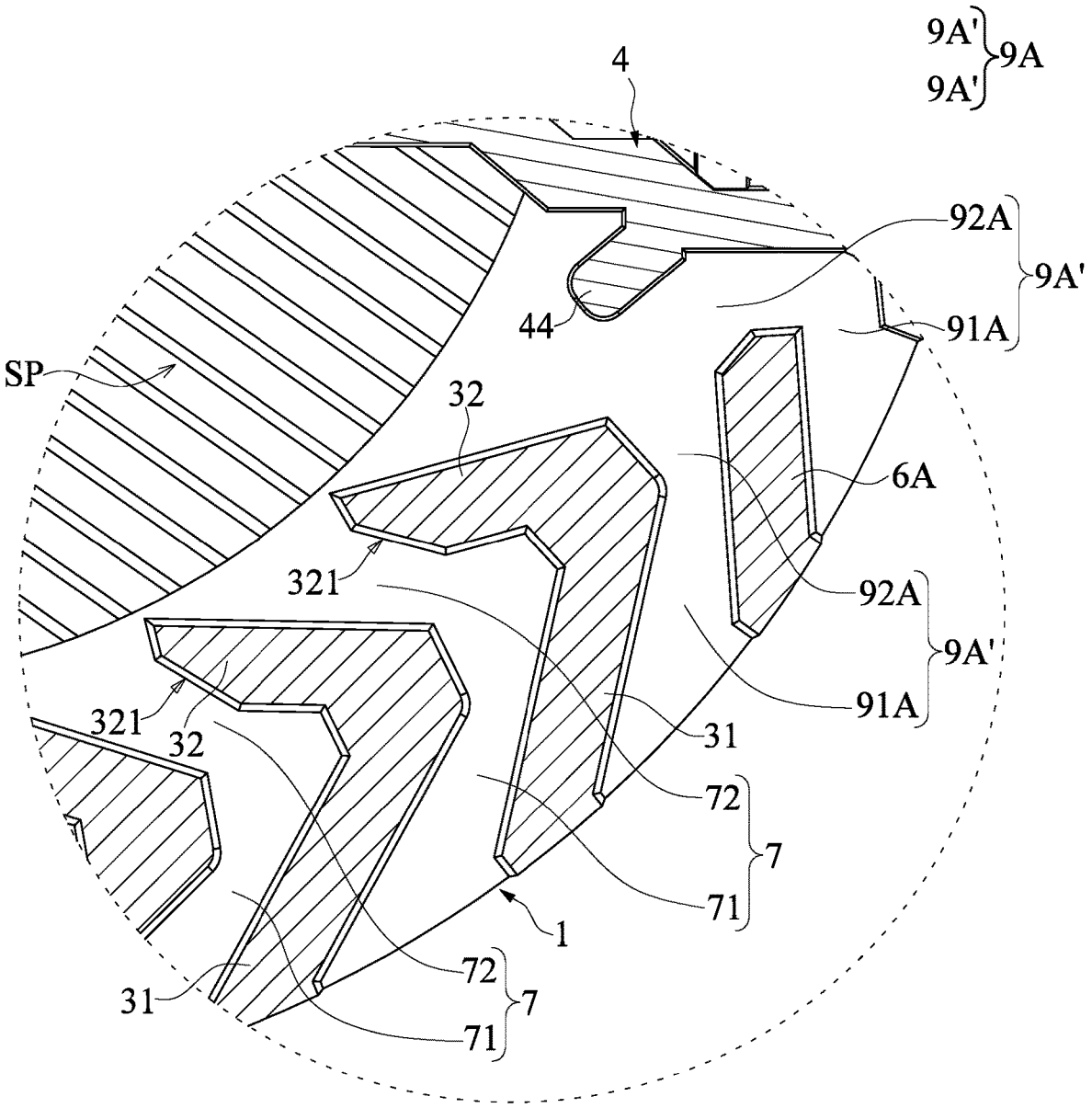
FIG. 6 is an enlarged view showing part VI of FIG. 4.

Referring to FIG. 4 to FIG. 6, the baffle ribs 3 are arranged annularly between the bottom plate 1 and the top plate 2. The chamber 100 is generally cylindrical and has the smoke collection space SP. Specifically, the baffle ribs 3 are spaced apart from each other, so that any two of the baffle ribs 3 adjacent to each other are provided with a main channel 7 that is in spatial communication with the smoke collection space SP there-between. Further, none of the baffle ribs 3 is disposed in the setting area A. It should be noted that the baffle ribs 3 are integrally connected to the top plate 2 in the present embodiment, but the present disclosure is not limited thereto. For example, the baffle ribs 3 can be integrally connected to the bottom plate 1.

Figure 7:
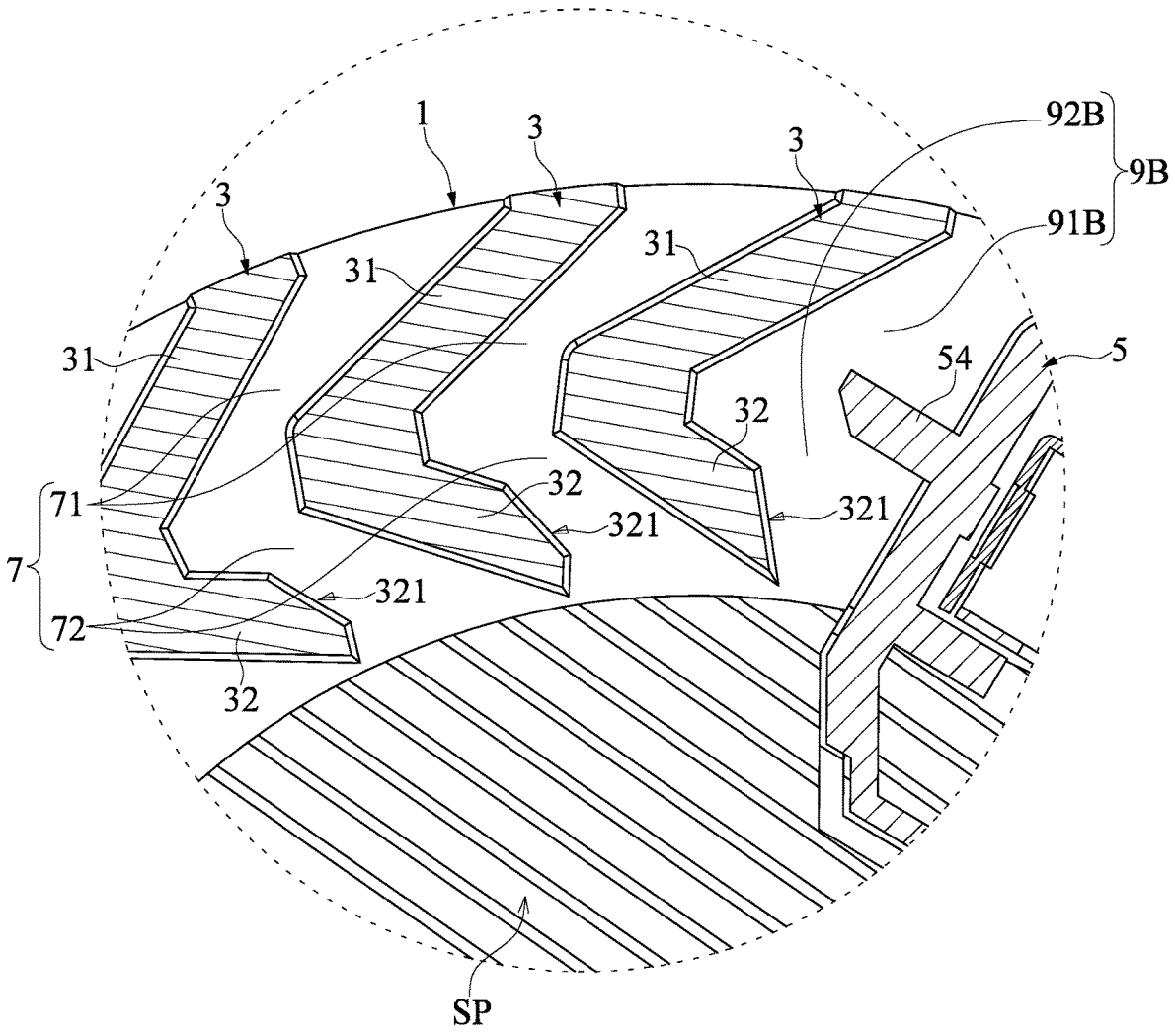
FIG. 7 is an enlarged view showing part VII of FIG. 4.

Referring to FIG. 6 and FIG. 7, in detail, each of the baffle ribs 3 is substantially in a V-shape, so as to have a first section 31 and a second section 32 connected to the first section 31. Any two of the baffle ribs 3 adjacent to each other are provided with the main channel 7. Any two of the first sections 31 adjacent to each other define a main inlet section 71, and any two of the second sections 32 adjacent to each other define a main outlet section 72. In other words, each of the main channels 7 is composed of the corresponding main inlet section 71 and the corresponding main outlet section 72. When smoke enters the smoke collection space SP of the chamber 100 through any of the main channels 7, the smoke sequentially passes through the corresponding main inlet section 71 and the corresponding main outlet section 72.

Further, a cross section of each of the main inlet sections 71 is tapered toward a center of the chamber 100, and a cross section of each of the main outlet sections 72 broadens toward the center of the chamber 100. Specifically, in any two of the first sections 31 adjacent to each other, one of the first sections 31 is arranged to extend diagonally toward to the other of the first sections 31, so that the corresponding main inlet section 71 is tapered toward the center of the chamber 100. A slope 321 is formed on the end of each the second sections 32. In any two of the second sections 32 adjacent to each other, the slope 321 of one of the second sections 32 is arranged to extend obliquely away from the other of the second sections 32, so that each of the main outlet sections 72 gradually broadens toward the center of the chamber 100. Accordingly, since each of the main inlet sections 71 are tapered toward the center of the chamber 100 and each of the main outlet sections 72 are broadened toward the center of the chamber 100, the moisture in the air cannot easily enter the smoke collection space SP.

Referring to FIG. 2 and FIG. 4, the transmitter base 4 is arranged in the smoke collection space SP. Specifically, the transmitter base 4 is arranged at a peripheral portion of the smoke collection space SP, and has a transmitting end 41 that faces and is in spatial communication with the smoke collection space SP and a first external end 42 opposite to the transmitting end 41. The first external end 42 faces the outside of the chamber 100. The first external outer end 42 is a closed structure and is not in spatial communication with the smoke collection space SP. Further, the transmitter base 4 in the present embodiment is composed of two groove structures matching with each other. The two groove structures of the transmitter base 4 form a transmitter accommodating space 43 that is configured to be disposed in the emitter 200. The two groove structures of the transmitter base 4 are respectively disposed on the bottom plate 1 and the top plate 2, but the present disclosure is not limited thereto. For example, the transmitter base 4 may also be a single groove structure disposed on the bottom plate 1 or the top plate 2. In addition, two first convex portions 44 are respectively formed on two side edges of the transmitter base 4 (as shown in FIG. 4).

The receiver base 5 is disposed in the smoke collection space SP. Specifically, the receiver base 5 is arranged at the peripheral portion of the smoke collection space SP, and has a receiving end 51 that faces and is in spatial communication with the smoke collection space SP and a second external end 52 opposite to the receiving end 51. The second external end 52 faces the outside of the chamber 100. The second external outer end 52 is a closed structure and is not in spatial communication with the smoke collection space SP. Further, the receiver base 5 in the present embodiment is composed of two groove structures matching with each other. The two groove structures of the receiver base 5 form a receiver accommodating space 53 that is configured to be disposed in the receiver 300. The two groove structures of the receiver base 5 are respectively disposed on the bottom plate 1 and the top plate 2, but the present disclosure is not limited thereto. For example, the receiver base 5 may also be a single groove structure disposed on the bottom plate 1 or the top plate 2. In addition, two second convex portions 54 are respectively formed on two side edges of the receiver base 5 (as shown in FIG. 4).

Further, the receiver base 5 is disposed apart from the transmitter base 4, and the center point C of the chamber 100, being taken as an apex of the bottom plate 1 or the top plate 2, the receiver base 5, and the transmitter base 4 jointly define an angle being in a range of 45 degrees to 65 degrees, and the angle in the present embodiment is 59 degrees. In other words, the transmitting end 41 of the transmitter base 4 and the receiving end 51 of the receiver base 5 face the center point C. As shown in FIG. 4, the transmitting end 41 and the receiving end 51 have the angle with respect to the center point C in the chamber 100.

Referring to FIG. 5, the assist rib 6 in the present embodiment is substantially in a T-shape. The assist rib 6 is disposed in the setting area A. The chamber 100 has two minor channels 8, one of the two minor channels 8 is arranged between the assist rib 6 and one of the first convex portions 44 adjacent to the assist rib 6, and another one of the two minor channels 8 is arranged between the assist rib 6 and one of the second convex portions 54 adjacent to the assist rib 6. The two minor channels 8 are in spatial communication with the smoke collection space SP. Specifically, the chamber 100 only has the two minor channels 8 in the setting area A, and does not have any of the main channels 7.

In detail, each of the minor channels 8 is in a V-shape by the design of the shape of the assist rib 6 that is in the T-shape, so that each of the minor channels 8 has a minor inlet section 81 and a minor outlet section 82 that is connected to the minor inlet section 81. A cross section of each of the minor inlet sections 81 is tapered toward a center of the chamber 100, and a cross section of each of the minor outlet sections 82 broadens toward the center of the chamber 100. Accordingly, since each of the minor inlet sections 81 and each of the minor outlet sections 82 are tapered, the moisture in the air cannot enter the smoke collection space SP. That is to say, each of the minor channels 8 has the same effect as each of the main channels 7.

Referring to FIG. 6, the chamber 100 has a side channel 9A that is arranged between one of the first convex portions 44 away from the assist rib 6 and one of the baffle ribs 3 adjacent to the transmitter base 4. The side channel 9A defines a side entrance area 91A and a side exit area 92A connected to the side entrance area 91A in an order from the outside of the chamber 100 toward the direction of the smoke collection space SP. A cross section of the side entrance areas 91A is tapered toward a center of the chamber 100, and a cross section of each of the side exit areas 92A broadens toward the center of the chamber 100.

Preferably, a side auxiliary rib 6A is provided between one of the first convex portions 44 of the chamber 100 and one of the baffle ribs 3 adjacent to the transmitter base 4, so that the side channel 9A has two minor side channels 9A'. Each of the two minor side channels 9A' has the side entrance area 91A and the side exit area 92A, but the present disclosure is not limited thereto.

Referring to FIG. 7, the chamber 100 has a side channel 9B that is arranged between one of the second convex portions 54 away from the assist rib 6 and one of the baffle ribs 3 adjacent to the receiver seat 5. The side channel 9B defines a side entrance area 91B and a side exit area 92B connected to the side entrance area 91A in an order from the outside of the chamber 100 toward the direction of the smoke collection space SP. A cross section of the side entrance areas 91B is tapered toward a center of the chamber 100, and a cross section of each of the side exit areas 92B broadens toward the center of the chamber 100. The emitter 200 is disposed in the transmitter base 4, and is capable of emitting a detection light toward the smoke collection space SP. Specifically, the emitter 200 is directed toward the transmitting end 41 of the transmitter base 4, the emitter 200 can emit the detection light in the direction of the center point C of the chamber 100. More specifically, the emitter 200 in the present embodiment is an infrared light-emitting diode, and the detection light is infrared light, but the present disclosure is not limited thereto.

The receiver 300 is disposed in the receiver base 5 and is capable of receiving the detection light. Specifically, the receiver 300 faces the receiving end 51 of the receiver base 5, so that the receiver 300 can receive the detection light passing through the receiving end 51. More specifically, the receiver 300 in the present embodiment is an infrared light receiving diode, but the present disclosure is not limited thereto.

In conclusion, the smoke detector 1000 and the chamber 100 of the present disclosure can reduce the false alarms caused by the detection of cooking fumes (i.e., white smoke) generated during cooking through the design with an angle being in a range of 45 degrees to 65 degrees among the transmitter base 4, the receiver base 5, and the center point C of the chamber 100. Specifically, when the detection light is irradiated on smoke, the detection light can penetrate the white smoke particles more easily than the black smoke particles (i.e., the smoke generated during a fire), and a reflection angle when the detection light is irradiated on the black smoke particles is larger than a reflection angle when irradiated on the white smoke particles. When the emitter 200 disposed in the transmitter base 4 emits the detection light, it would be significantly more difficult for the detection light reflected by the white smoke particles to be received by the receiver 300 disposed in the receiver base 5, as compared to the detection light reflected by the black smoke particles. Accordingly, the smoke detector 1000 can prevent the receiver 300 from receiving the detection light reflected by the white smoke particles, so as to reduce the false alarms issued from the smoke detector due to cooking fumes.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A smoke detector, comprising:

a chamber including:

a bottom plate and a top plate;

a plurality of baffle ribs disposed between the bottom plate and the top plate, wherein the baffle ribs are spaced apart from each other, wherein the chamber defines a smoke collection space surrounded by the top plate, the bottom plate, and the baffle ribs, wherein the chamber has a plurality of main channels that are in spatial communication with the smoke collection space, and wherein any two of the baffle ribs adjacent to each other are provided with one of the main channels there-between;

a transmitter base arranged in the smoke collection space; and a receiver base arranged in the smoke collection space, wherein the receiver base is arranged apart from the transmitter base, and a center point of the chamber, being taken as an apex, the receiver base, and the transmitter base jointly define an angle being in a range of 45 degrees to 65 degrees;

an emitter disposed in the transmitter base, wherein the emitter is capable of emitting a detection light toward the smoke collecting space; and a receiver disposed in the receiver base, wherein the receiver is capable of receiving the detection light;

wherein a setting area is defined between the transmitter base and the receiver base within the chamber, none of the baffle ribs is disposed in the setting area, and the chamber includes an assist rib that is disposed in the setting area, wherein the transmitter base has two first convex portions respectively arranged on two opposite edges thereof, wherein the receiver base has two second convex portions respectively arranged on two opposite edges thereof, wherein the chamber has two minor channels, one of the two minor channels is arranged between the assist rib and one of the first convex portions adjacent to the assist rib, and another one of the two minor channels is arranged between the assist rib and one of the second convex portions adjacent to the assist rib, and wherein the chamber has two side channels, one of the two side channels is arranged between one of the first convex portions away from the assist rib and one of the baffle ribs adjacent to the transmitter base, and another one of the two side channels is arranged between one of the second convex portions away from the assist rib and one of the baffle ribs adjacent to the receiver seat.

2. The smoke detector according to claim 1, wherein the bottom plate has a first rough portion located at a center position of the bottom plate, and wherein the top plate has a second rough portion located at a center position of the top plate.

3. The smoke detector according to claim 2, wherein each of the first rough portion and the second rough portion is in a step shape, and wherein the shape of the first rough portion and the shape of the second rough portion are symmetrical to each other.

4. The smoke detector according to claim 1, wherein each of the baffle ribs is substantially in a V-shape, so that each of the main channels is defined as a main inlet section and a main outlet section that is connected to the main inlet section, wherein a cross section of each of the main inlet sections is tapered toward a center of the chamber, and wherein a cross section of each of the main outlet sections broadens toward the center of the chamber.

5. The smoke detector according to claim 1, wherein the transmitter base and the receiver base are respectively arranged at a peripheral portion of the smoke collection space, wherein the emitter has a transmitting end and a first external end that is opposite to the transmitting end, wherein the transmitting end faces toward and is in spatial communication with the smoke collection space, and the first external end faces an outside of the chamber, wherein the receiver has a receiving end and a second external end that is opposite to the receiving end, and wherein the receiving end faces toward and is in spatial communication with the smoke collection space, and the second external end faces the outside of the chamber.

6. A chamber, comprising:

a bottom plate and a top plate;

a plurality of baffle ribs disposed between the bottom plate and the top plate, wherein the baffle ribs are spaced apart from each other, wherein the chamber defines a smoke collection space surrounded by the top plate, the bottom plate, and the baffle ribs, wherein the chamber has a plurality of main channels that are in spatial communication with the smoke collection space, and wherein any two of the baffle ribs adjacent to each other are provided with one of the main channels there-between;

a transmitter base arranged in the smoke collection space; and a receiver base arranged in the smoke collection space, wherein the receiver base is arranged apart from the transmitter base, and a center point of the chamber, being taken as an apex, the receiver base, and the transmitter base jointly define an angle being in a range of 45 degrees to 65 degrees;

wherein a setting area is defined between the transmitter base and the receiver base within the chamber, none of the baffle ribs is disposed in the setting area, and the chamber includes an assist rib that is disposed in the setting area, wherein the transmitter base has two first convex portions respectively arranged on two opposite edges thereof, wherein the receiver base has two second convex portions respectively arranged on two opposite edges thereof, wherein the chamber has two minor channels, one of the two minor channels is arranged between the assist rib and one of the first convex portions adjacent to the assist rib, and another one of the two minor channels is arranged between the assist rib and one of the second convex portions adjacent to the assist rib, and wherein the chamber has two side channels, one of the two side channels is arranged between one of the first convex portions away from the assist rib and one of the baffle ribs adjacent to the transmitter base, and another one of the two side channels is arranged between one of the second convex portions away from the assist rib and one of the baffle ribs adjacent to the receiver seat.

7. The chamber according to claim 6, wherein the bottom plate has a first rough portion located at a center position of the bottom plate, and wherein the top plate has a second rough portion located at a center position of the top plate.

8. The chamber according to claim 7, wherein each of the first rough portion and the second rough portion is in a step shape, and wherein the shape of the first rough portion and the shape of the second rough portion are symmetrical to each other.

9. The chamber according to claim 6, wherein each of the baffle ribs is substantially in a V-shape, so that each of the main channels is defined as a main inlet section and a main outlet section that is connected to the main inlet section, wherein a cross section of each of the main inlet sections is tapered toward a center of the chamber, and wherein a cross section of each of the main outlet sections broadens toward the center of the chamber.

* * * * *